US005884405A

United States Patent [19]

Breeden

[11] Patent Number: 5,884,405

[45] Date of Patent: Mar. 23, 1999

[54] METHOD AND TOOL FOR JOINING SHEET METAL STRUCTURES

[76] Inventor: Harlan Breeden, 4119 Leonard Springs Rd., Bloomington, Ind. 47403

[21] Appl. No.: 704,440

[22] Filed: Aug. 27, 1996

[51] Int. Cl.[6] ..... B21D 28/02

[52] U.S. Cl. ..... 30/366; 30/363; 29/21.1

[58] Field of Search ..... 30/363, 366, 358; 29/21.1, 243.5, 432; 92/325

[56] References Cited

U.S. PATENT DOCUMENTS

| | | | |
|---|---|---|---|
| 345,687 | 7/1886 | Hayes | 72/325 |
| 2,969,754 | 1/1961 | Wilson | 29/513 |
| 3,010,207 | 11/1961 | Barnes | 30/366 |
| 3,082,850 | 3/1963 | Weening | 29/512 |
| 3,261,073 | 7/1966 | Klenk | 29/21.1 |
| 3,411,339 | 11/1968 | Brown | 29/513 |
| 3,505,714 | 4/1970 | Boileau | 29/21.1 |
| 3,541,685 | 11/1970 | Gizdich | 30/363 |
| 3,624,876 | 12/1971 | Irvin | 29/509 |
| 3,714,688 | 2/1973 | Olson | 72/325 |
| 3,877,280 | 4/1975 | Cornell | 30/366 |
| 5,022,253 | 6/1991 | Parlatore | 72/325 |
| 5,617,619 | 4/1997 | Knudson | 29/21.1 |

*Primary Examiner*—Hwei-Siu Payer
*Attorney, Agent, or Firm*—Woodard, Emhardt, Naughton Moriarty & McNett

[57] ABSTRACT

A method and tool for joining a first metal structure, such as a sheet metal stud and a second metal structure, such as a sheet metal runner is disclosed. The tool includes a first clamp and a second clamp for moving with respect to each other to clamp the sheet metal therebetween. A linearly reciprocating punch being retrieved by a spring bias punches through the sheet metal to form a tongue for joining the sheets together. Angular relationships between the punching direction and the sheet metal are disclosed as well as a movable, yet lockable, inter-relationship between the clamping mechanism and the punching mechanism to allow a single stroke punching and clamping action.

20 Claims, 5 Drawing Sheets

METHOD AND TOOL FOR JOINING SHEET METAL STRUCTURES

BACKGROUND OF THE INVENTION

This invention relates generally to hand-held power tools, and more specifically to a tool for joining a first sheet metal structure and a second sheet metal structure, such as a metal stud and runner used in wall construction.

Horizontal metal runners and vertical metal studs are used in the fabrication of interior wall structures and exterior wall structures in buildings. Conventionally, these are joined together by fasteners, such as screws driven by power guns. This approach is disadvantageous for several reasons, including the cost, materials and lack of one hundred percent (100%) reliability of shooting a fastener through the metal members. Other devices exist generally for joining sheet metal together by punching and crimping. However, insofar as applicant is aware, these devices have not enjoyed widespread acceptance, the industry tending to use conventional fastener technology. Some approaches have been shown in patents generally regarding punching and crimping metal. However, these do not provide the benefits, advantages and relative simplicity of the present invention.

SUMMARY OF INVENTION

The present invention provides in one embodiment, hand-held tool for joining a first metal structural member, such as a stud, and a second metal structural member, such as a runner together. A handle and a working end are provided. The working end includes a first clamping member and a second clamping member, a reciprocating punch member is movable along a punch direction for punching an associated opening and metal tongue through each of the metal structural members.

A method for joining such metal structures is also provided.

One object of the present invention is to provide a hand-held tool for joining metal structural members in a new and improved way. Another object is to provide a method thereof. These and other objects and advantages will become apparent from the following disclosure.

DESCRIPTION OF THE DRAWING FIGURES

DESCRIPTION OF THE PREFERRED EMBODIMENT

Figure 1:
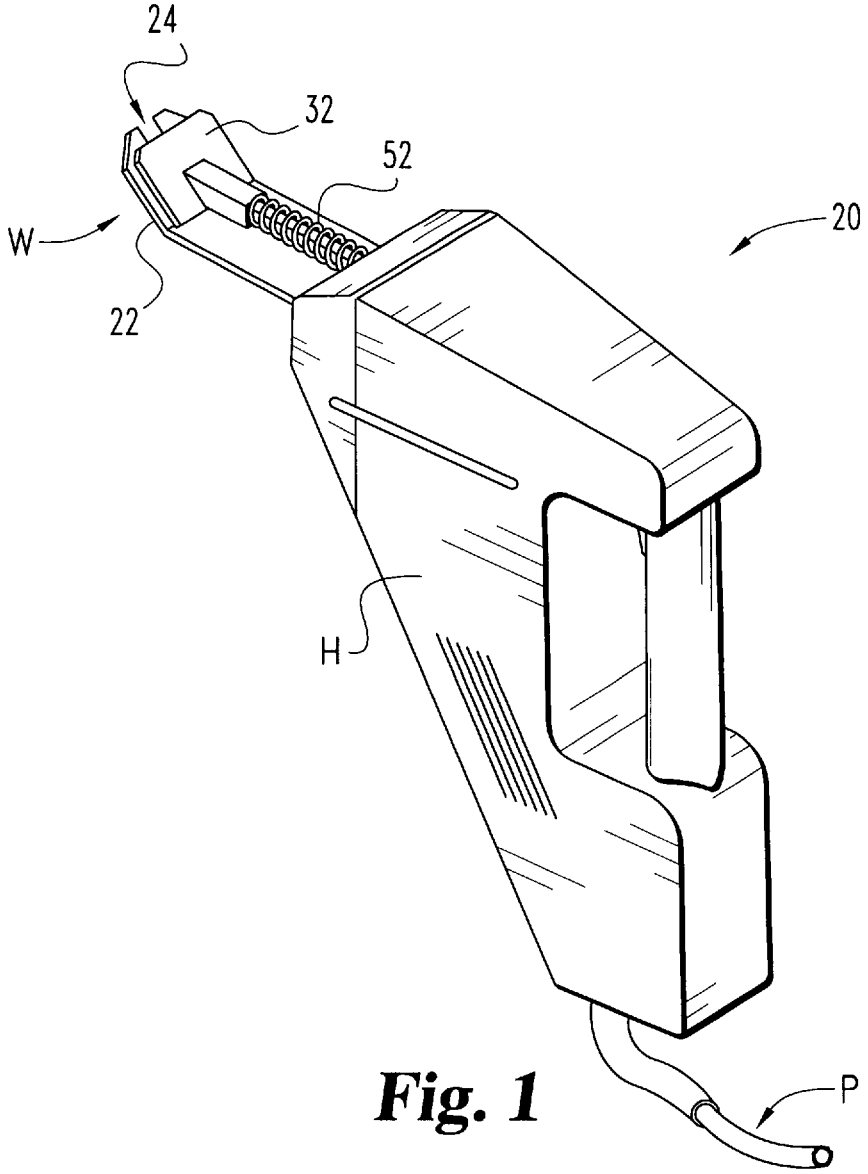
FIG. 1 is a rear perspective view of one embodiment of the present invention.
Figure 2:
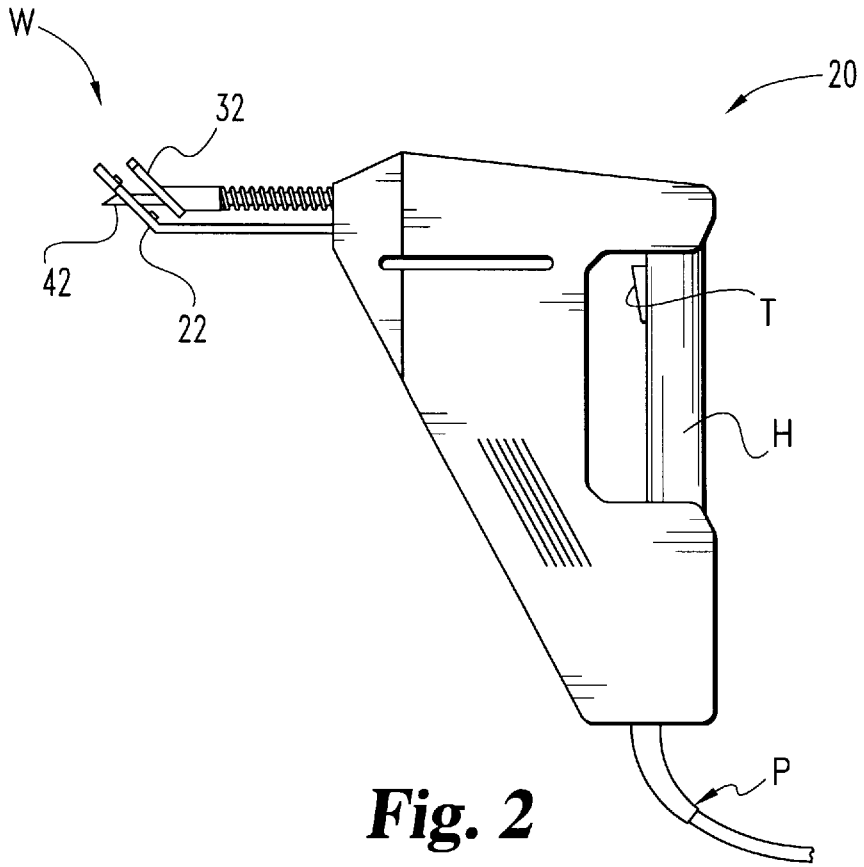
FIG. 2 is a side view of the tool of FIG. 1.
Figure 3:
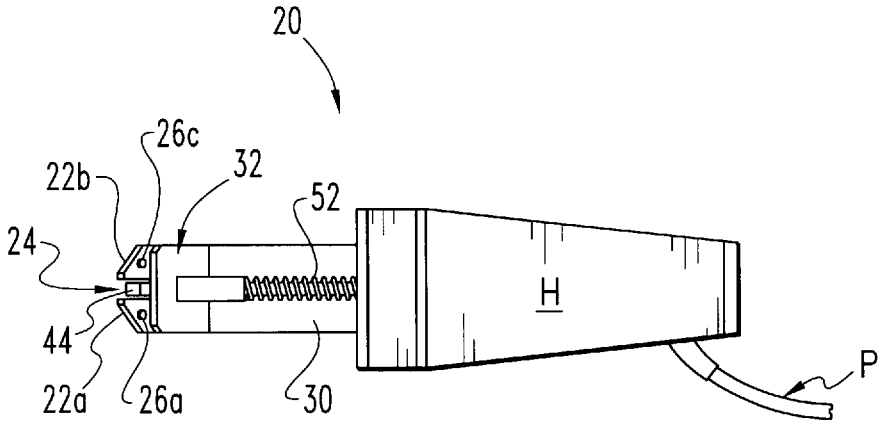
FIG. 3 is a top view of the tool of FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended. Any alteration and further modifications in the described device and method, and any further applications of the principles of the invention as described herein are contemplated as would normally occur to one skilled in the art to which the invention relates.

Referring to FIGS. 1–7, hand-held tool 20 according to one embodiment of the present invention is disclosed. The tool comprises handle H with working end W coupled thereto. Preferably, the working end projects outwardly from the handle in a gun configuration allowing convenience and accurate positioning of the working end with respect to the structural members to be joined. Handle H includes an actuating mechanism, such as trigger T, to actuate the non-human power preferably used to power the present tool. Such power may be provided from power cord P as illustrated. The cord may be an electrical cord and/or a compressed gas, such as a compressed air conduit. Such non-human power sources include electrical energy in the form of linear motors, solenoid motors, rotary motors with linear actuating devices, batteries, pneumatic pistons or other compressed air actuated devices, as well as mechanical spring mechanisms which, for example may be cocked prior to the discharge of potential energy by actuation of the trigger. Of the foregoing, it is believed that the preferred source of power is pneumatic power from compressed air or other gas from a portable compressed gas canister. The actuation device releases compressed air to provide an impulse discharge of energy to forwardly advance the punch 42 described further below.

Figure 7:
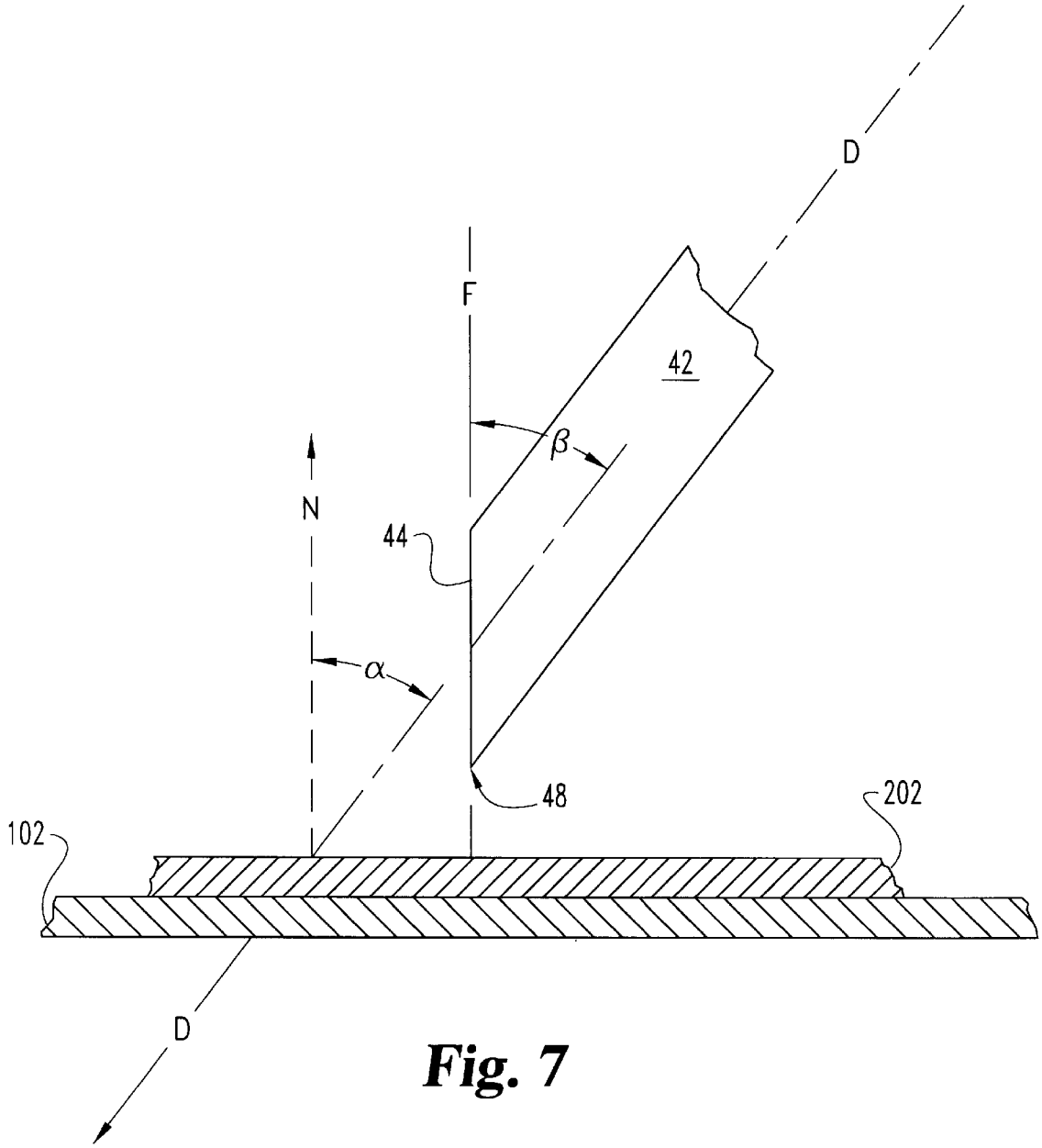
FIG. 7 is a partial side view showing the punch member in relation to the sheet metal being punched, including showing preferred geometric relationships.

Directing attention to the working end W, a first clamp member 22, second clamp member 32, and a punch member 42 are provided. Each of these may take a variety of configurations within the spirit of the present invention. In the preferred embodiment, first clamp 22 is held rigidly in place with respect to handle H by support arm 30 (see FIG. 4). Clamp 22 in this embodiment includes two portions, side prong 22*a* and side prong 22*b* defining recess 24 therebetween. In operation, punch 42 advances beyond first clamp 22 through the recess 24. Clamp 22 preferably includes one or more projections which wrap around from the backside of the work piece in engagement with the rear surface of the work piece. As illustrated, these are shown as projections 26*a*, 26*b* and 26*c*. In the preferred embodiment, a fourth projection (not shown) is also provided with the four projections in a rectangular configuration. In this embodiment, the projections maintain the first sheet metal member 102 above and out of contact with the remaining portions of clamp 22, leaving space 28 therebetween (see FIG. 4). Note that in the preferred embodiment, the arrangement of the clamps 22 and 32 are at an angle with respect to the punch direction D of punch member 42. This is illustrated in both FIG. 4 and FIG. 7. With specific reference to FIG. 7, angle $\alpha$ is defined as being between punch direction D and a vector N which is normal to the surface of the sheet metal 202 and 102 being punched, and which also is normal to the planar surfaces of the clamping members 22 and 32. This orientation, while not required for all aspects of the present invention, provides the preferred punch direction at angle $\alpha$ with respect to the sheet metal. Although angle $\alpha$ may be 0 with the punch direction being normal to the surface, it is preferred that the angle be non-normal. It is further preferred that it be in excess of about 10°, and in the preferred embodiment is believed to be optimized at about 45°. It has been found that this provides several advantageous aspects, including the use of a linear punch direction with the associated punch tongues being bent backwards at a degree beyond normal on the opposite side of the metal, thereby enhancing the interlocking action of the tongues. In this regard, punch face 44 may have a variety of surface geometries, but is preferably planar and as illustrated in FIG. 7 defines a plane F. Punch 42 also has a leading edge 48. Angle β is the angle between the punch face and the punch direction D. As illustrated in FIG. 7, by having punch face 44 angled inversely to the punch direction D, leading edge 48 of the punch is positioned to provide a cut or a bite against the sheet metal to be cut, thereby reducing incidences of deflection off the surface of the sheet metal. Angle β may be a variety of angles, depending on sharpness, machining considerations, and the angle α. It is believed in the preferred embodiment that angle β should be the same as or similar to angle α. Although punch face 44 is shown as rectangular, other shapes, such as for example triangular or arcuate, may be used.

Figure 4:
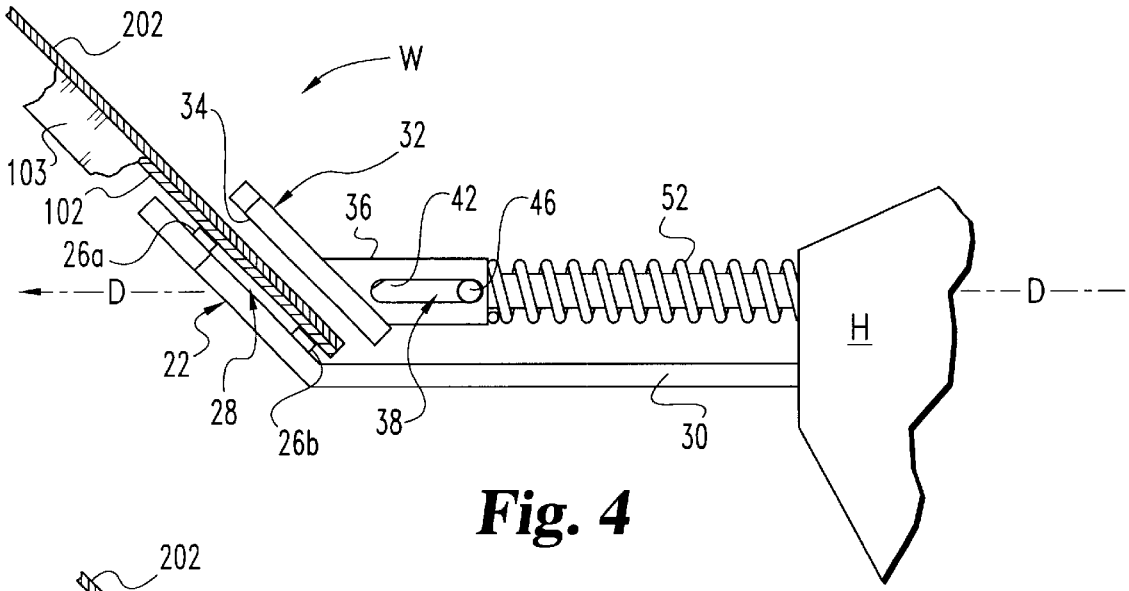
FIGS. 4, 5 and 6 are partial side views of the device of FIGS. 1–3 showing, in succession, one preferred embodiment of operation of the present invention joining metal structural members.

A biasing spring or other retrieval mechanism such as spring 52 is preferably used to bias at least one of the clamping mechanisms such as clamp 32 rearwardly after operation. The force of the power source on the punch 42, and ultimately on the clamp 32, overcome the bias force of spring 52 during the punching operation. After the force is exerted during the punching operation, spring 52 acts in tension being attached to punch 42 and/or to clamp 32 to retract them to their ready position as illustrated in FIG. 4. A variety of other retrieval mechanisms, including leaf springs, or otherwise may be used.

Figure 5:
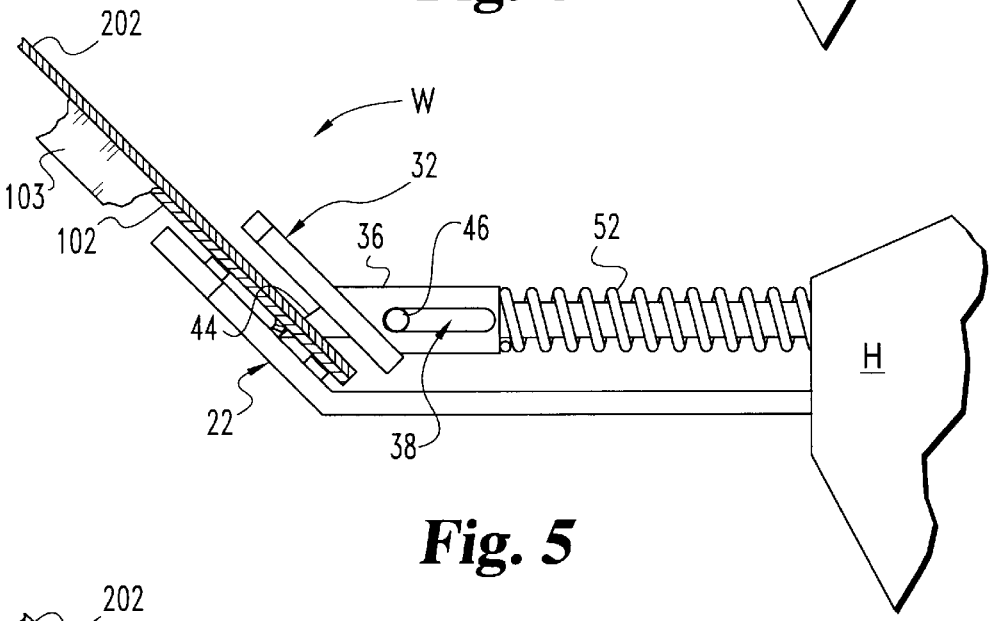
Figure 6:
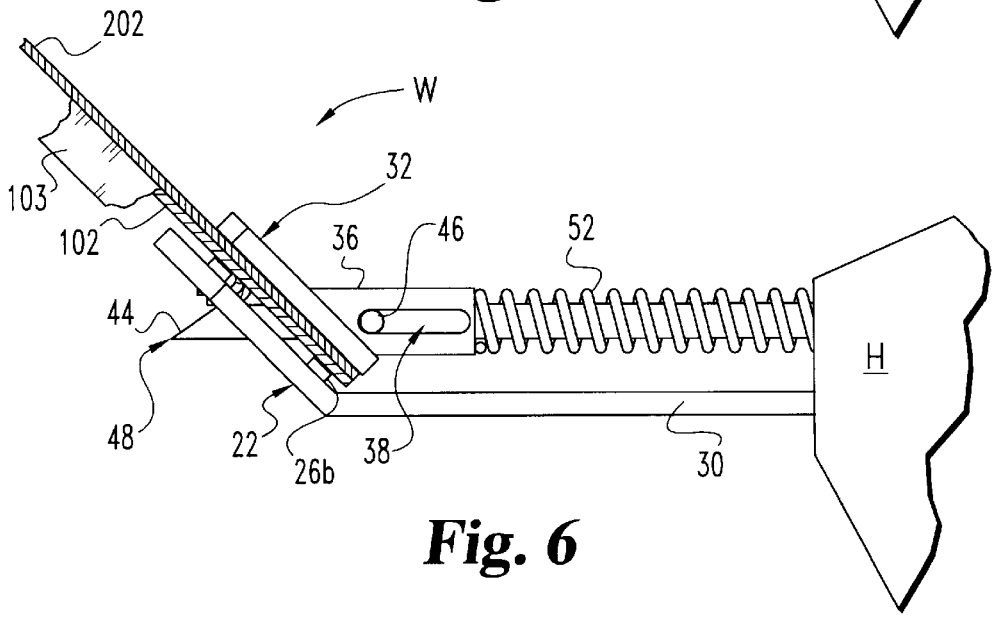

FIGS. 4, 5 and 6 show the punching operation of the present invention sequentially. Second clamp 32 includes a mount or sleeve 36 rigidly affixed as a part thereof. Clamp face 34 is on the front side of the clamp to engage the sheet metal 202 to be joined. Although a variety of orientations may be provided, in the preferred embodiment mount 36 surrounds the longitudinal portion of punch 42. In this orientation, punch 42 is longitudinally movable with respect to clamp 32 along punch direction D. However, this longitudinal movement in the preferred embodiment is limited by the interaction of stop member 46 rigidly attached to punch 42 on the one hand, and slot 38 in mount 36, on the other hand. As illustrated by comparing FIGS. 4 and 5, in the preferred embodiment, after the punch is actuated by the power source to move forwardly in direction D, initially punch 42 and its associated stop 46 advance forwardly in slot 38. At the forward-most or distal end of this travel, stop 46 engages the left-most portion of slot 38 as illustrated in FIG. 5. Thereafter, the continued force imparted simultaneously continues the advance of punch 42 and begins the forward advance of clamp 32 (including mount 36), as illustrated by comparing FIGS. 5 and 6. With such arrangement, punch 42 punches through both sheet metal 202 and sheet metal 102 cutting and forming two tongues to join the two pieces of sheet metal together. Also, given the force actuated on one clamping member and the fixed relation of the other clamping member, the two pieces of sheet metal are actively and forcibly clamped together during the punching operation. In the preferred embodiment, this occurs in rapid succession after the initiation of the punching operation and during the completion of the punching operation. As illustrated in FIG. 6, clamp 32 forces or slams into sheet metal 202, compressing it with sheet metal 102. Meanwhile, the punch is wrapping the tongues back around to effect a joint. This arrangement provides a mechanically simple single stroke action clamping and punching operation.

Figure 8:
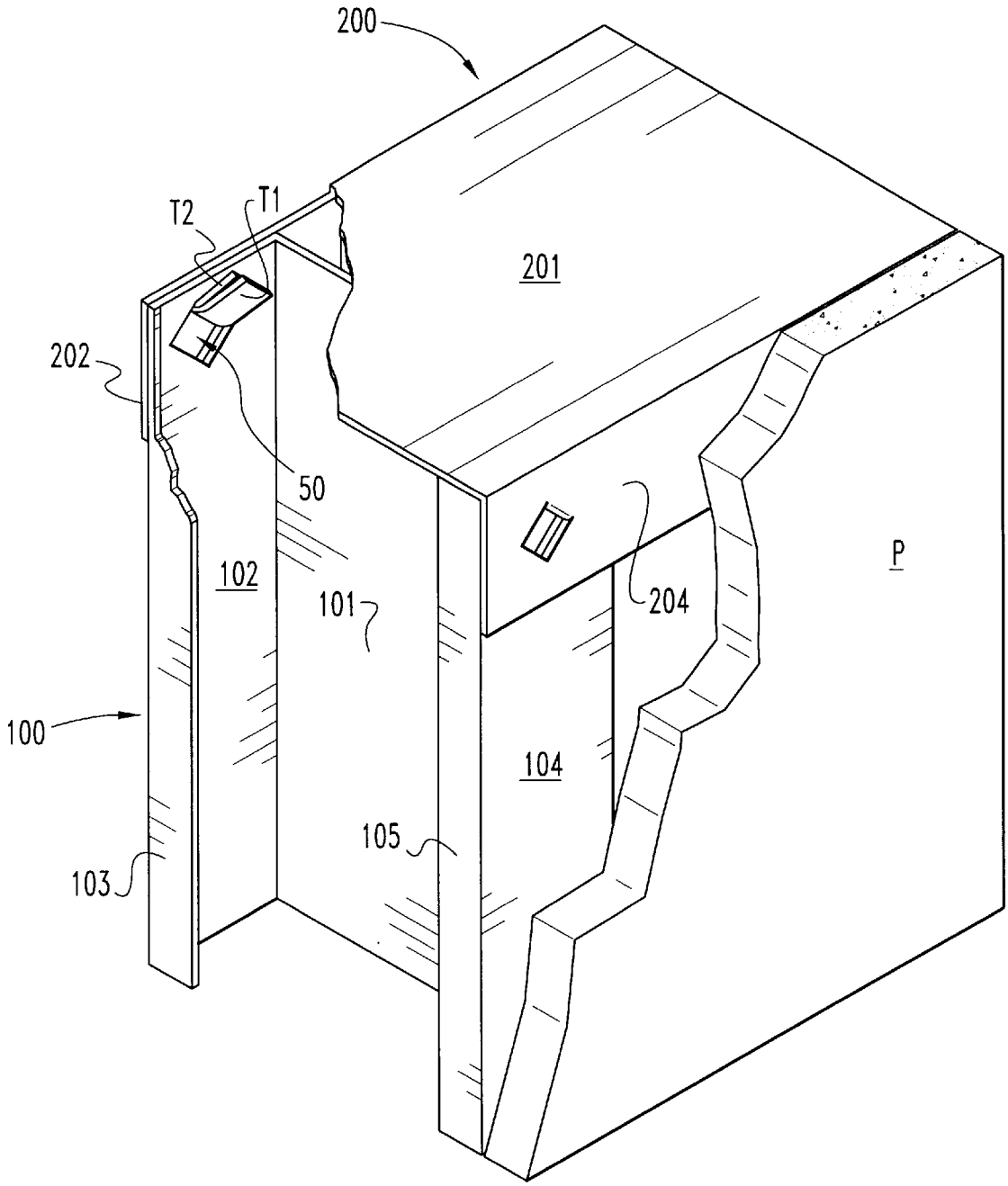
FIG. 8 is a top perspective view, partially cut away for purposes of drawing clarity, showing a metal structural member comprising a vertical stud connected to a metal structural member comprising a runner with a wall panel thereon in accordance with the present invention.

FIG. 8 shows a preferred embodiment of a portion of wall structure according to the present invention. A first metal structural member 100 is connected to second structural metal member 200. Number 100 as illustrated is a vertical sheet metal stud, whereas member 200 is a horizontal runner, such as a head track or foot track. Wall panel P, such as sheet rock or the like, is attached by screws, adhesives or other such mechanisms as is known. Referring to the cutaway portion of the metal members, tongues T1 and T2 are illustrated as are formed according to the present invention by the punching operation leaving opening 50 in the sidewall flange 102 of member 100. In the preferred embodiment, member 100 includes a vertical web member 101, as well as a pair of oppositely disposed flange members 102 and 104 which are vertical and parallel to each other as illustrated. The side flange members also have inwardly protruding flange members 103 and 105 to provide additional stiffness and rigidity in member 100. Member 200 includes a horizontal web 201 as well as two vertical flanges, flange 202 and flange 204. Each of the above-mentioned flanges is preferably oriented generally perpendicular to their respective webs and/or flanges as illustrated. Such members as typically used for the present invention comprise eighteen (18) to twenty-six (26) gauge metal, such as galvanized steel, although other gauges and materials and flange configurations may be contemplated.

The presence of projections, such as projection **26*a*, facilitate in the clamping operation by allowing the present invention to wrap around protruding flanges such as inward flange 103. Moreover, such projections may aide in quick and proper alignment of the working end of the device by giving a contact surface which the operator by pull backwardly against the flange, such as flange 103**, to hold the alignment prior to punching.

The present invention provides a method for joining the metal structural members previously described. Such method entails placing a member, such as member 200, horizontally in a building, and placing a vertical member, such as member 100 there against, preferably between the flanges 202 and 204. Thereafter, a tool according to the present invention previously described may be used. A first clamping member 22 is placed in contact with flange 102, and in particular with the projections, such as projections **26*a*, 26*b* and/or 26*c* engage the rear surface of flange 102. As previously described, clamp 32 on the front side engages metal flange 202. The operator actuates the power source to drive reciprocating punch member 42 forward along a linear punch direction. Metal tongues T1 and T2 are formed by being driven beyond a plane defined by flange 102 prior to the punching operation. After such joining operation of structural members 100 and 200**, panel P may be attached using known methods. The attachment of panel P tends to stiffen the entire wall structure into a unitary and structurally sound unit.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A hand-held tool for joining a first sheet metal structural member and a second sheet metal structural member, comprising:

a handle for an operator to hold and position the tool; and, a working end coupled to said handle for receiving a portion of the first sheet metal structural member and a portion of the second sheet metal structural member, said working end comprising a first clamping member and a second clamping member, wherein one of said first and second clamping members is movable, a reciprocating punch member movable with respect to said first clamping member and with respect to said second clamping member, said punch member being driven forward by a non-human power source along a punch direction for punching an associated opening and metal tongue through each of the first sheet metal structural member and the second sheet metal structural member, the tongues being folded and driven by said punch member beyond a plane defined by the first sheet metal structural member prior to said punching.

2. The tool of claim 1 and further comprising a spring biasing said punch member rearwardly along said punch direction after said punching.

3. The tool of claim 2 wherein said punch direction is oriented at an angle in excess of about ten degrees from normal with respect to said plane defined by the first sheet metal structural member.

4. The tool of claim 3 wherein said first clamping member comprises a projection in engagement with a rear surface of the first metal member, said projection defining a space behind said first metal member through which said punch member passes during punching, wherein said projection allows said first clamping member to engage said rear surface around a flange member projecting generally perpendicular to and rearward of said rear surface.

5. The tool of claim 4 wherein said punch member is slidable along said second clamping member, and wherein said second clamping member forces the first metal structural member and the second metal structural member together during punching.

6. The tool of claim 5 wherein said punch member has a front face, wherein said front face is disposed at an angle greater than about ten degrees from normal with respect to said punch direction, and wherein during punching said front face is non-parallel with respect to said plane defined by the first sheet metal structural member.

7. The tool of claim 6 and further comprising a stop member between said punch member and said second clamping member to limit movement therebetween, wherein during punching said punch member contacts the second metal member, and said stop member engages said second clamping member to fix said punch member and said second clamping member along said punch direction, and thereafter said second clamping member forces the first metal structural member and the second metal structural member together.

8. The tool of claim 7 wherein said punch direction is oriented at an angle of about forty-five degrees from normal with respect to said plane defined by the first sheet metal structural member.

9. The tool of claim 8 wherein said power source comprises compressed gas.

10. The tool of claim 8 wherein said power source comprises electrical energy.

11. The tool of claim 1 wherein said punch direction is oriented at an angle in excess of about ten degrees from normal with respect to said plane defined by the first sheet metal portion structural member.

12. The tool of claim 11 and further comprising a spring biasing said punch member rearwardly along said punch direction after said punching.

13. The tool of claim 1 wherein said first clamping member comprises a projection in engagement with a rear surface of said first metal member, said projection defining a space behind said first metal member through which said punch member passes during punching, wherein said projection allows said first clamping member to engage said rear surface around a flange member projecting generally perpendicular to and rearward of said rear surface.

14. The tool of claim 1 wherein said punch member is slidable along said second clamping member, and wherein said second clamping member forces the first metal structural member and the second metal structural member together during punching.

15. The tool of claim 1 wherein said punch member has a front face, wherein said front face is disposed at an angle greater than about ten degrees from normal with respect to said punch direction, and wherein during punching said front face is non-parallel with respect to said plane defined by the sheet first metal structural member.

16. The tool of claim 1 and further comprising a stop member between said punch member and said second clamping member to limit movement therebetween, wherein during punching said punch member contacts the second metal member, and said stop member engages said second clamping member to fix said punch member and said second clamping member along said punch direction, and thereafter said second clamping member forces the first metal structural member and the second metal structural member together.

17. The tool of claim 1 wherein said punch direction is oriented at an angle of about forty-five degrees from normal with respect to said plane defined by the sheet metal portion.

18. A hand-held tool for joining a first sheet metal structural member and a second sheet metal structural member, comprising:

a handle for an operator to hold and position the tool; and, a working end coupled to said handle for receiving a portion of the first metal structural member and a portion of the second metal structural member, said working end comprising a first clamping member, a reciprocating punch member movable with respect to said first clamping member, said punch member being driven forward by a non-human power source along a linear punch direction for punching an associated opening and metal tongue through each of the first metal structural member and the second metal structural member, the tongues being folded and being driven by said punch member beyond a plane defined by a portion of the first metal structural member prior to said punching, wherein said punch direction is oriented at an angle in excess of about ten degrees from normal with respect to said plane defined by the portion of the first metal structural member.

19. The tool of claim 18 wherein said punch member has a front face, wherein said front face is disposed at an angle greater than about ten degrees from normal with respect to said punch direction, and wherein during punching said front face is non-parallel with respect to said plane defined by the sheet metal portion.

20. The tool of claim 18, wherein during punching said punch member contacts the second metal structural member, and a second clamping member forces the first metal structural member and the second metal structural member together.

* * * * *